United States Patent [19]

Sekiguchi

[11] Patent Number: 4,954,097

[45] **Date of Patent: * Sep. 4, 1990**

[54] CONNECTOR PLUG WITH LOCKING MECHANISM

[75] Inventor: Shigemi Sekiguchi, Kiryu, Japan

[73] Assignee: Hosiden Electronics Co. Ltd., Osaka, Japan

[ * ] Notice: The portion of the term of this patent subsequent to May 29, 2007 has been disclaimed.

[21] Appl. No.: 403,511

[22] Filed: Sep. 6, 1989

[30] Foreign Application Priority Data

Sep. 21, 1988 [JP] Japan ..... 63-124293[U]

[51] Int. Cl.[5] ..... H01R 13/627

[52] U.S. Cl. ..... 439/352; 439/357; 439/610

[58] Field of Search ..... 439/610, 345, 347, 348, 439/350, 351, 352, 353, 354, 355, 356, 357, 358; 285/315, 316, 319

[56] References Cited

U.S. PATENT DOCUMENTS

| | | | |
|---|---|---|---|
| 4,243,290 | 1/1981 | Williams | 439/610 |
| 4,737,124 | 4/1988 | Ezure et al. | 439/610 |
| 4,810,210 | 3/1989 | Komatsu | 439/610 |

*Primary Examiner*—Neil Abrams
*Assistant Examiner*—Khiem Nguyen
*Attorney, Agent, or Firm*—Pollock, Vande Sande and Priddy

[57] ABSTRACT

In a connector plug with a locking mechanism which can be locked to the mating socket, no matter what part of the plug may be gripped when inserting it into the mating socket, and can be unlocked only by pulling a tubular member of the plug, an insulating body holding pin contacts is disposed in a cylindrical front half portion of a metal cover whose rear half portion is semi-cylindrical. The cylindrical portion of the metal cover has cut therein U-shaped grooves, defining tongue-shaped locking pieces each having a protrusion. The semi-cylindrical portion of the metal cover has attached thereto a metal clamper for clamping a cable and is covered with a semi-cylindrical auxiliary cover to form a rear cylindrical portion. Elastic support pieces of a resin material for supporting the tongue-shaped locking pieces on the inside thereof are axially slidably mounted in the cylindrical portion of the metal cover, and the elastic support pieces are forwardly biased by a coiled spring disposed around the metal cover. The rear half portion of the metal cover and the auxiliary cover are received in a cap of a resin material, and the entire plug structure is housed in the tubular member of a resin material in such a manner that the elastic support pieces can be moved back.

6 Claims, 2 Drawing Sheets

CONNECTOR PLUG WITH LOCKING MECHANISM

BACKGROUND OF THE INVENTION

The present invention relates to a connector plug with a locking mechanism which can be locked to the mating socket when inserted thereinto.

For example, in U.S. Pat. No. Re. 32,864 there are disclosed some connector plugs with locks which are of the type that can be locked to the mating socket when inserted thereinto, no matter what part of the plug is gripped when inserting it, and can be unlocked and pulled out therefrom only when a tubular member of the plug is pulled. In one of the connector plugs disclosed in this patent an insulating body carrying pin contacts is disposed between a pair of semi-cylindrical metal covers. Such a connector plug is defective in that the two semi-cylindrical metal covers readily come out of position or fall off during assembling and are easily deformed after assembling. In addition, these metal covers have openings in which elastic locking pieces are disposed and openings through which portions of an actuating member for sliding elastic support pieces project, and consequently, they are not very effective for electromagnetic shielding.

The inventor of this application has proposed in his prior U.S. patent application Ser. No. 330,534 (filed Mar. 30, 1989) a connector plug with a locking mechanism which has an excellent electromagnetic shielding property. In the connector plug of the prior application, a metal shell is put on the rear end portion of a cylindrical metal cover having disposed therein an insulating body holding pin contacts and a small-diametered rear end portion of the metal shell is clamped around a shielding braid of a cable, so that it is necessary to connect lead wires of the cable to the pin contacts held by the insulating body and then dispose the insulating body at a predetermined position in the cylindrical metal cover, followed by putting the metal shell on the rear end portion of the metal cover from behind. In the assembling step there is a risk that the shielding braid folded back on the cable will be shifted forwardly out of position with the inner wall of the small-diametered rear end portion of the metal shell. To avoid this, the metal shell must be carefully mounted on the metal cover, and consequently, assembling of this connector plug is very cumbersome.

SUMMARY OF THE INVENTION

It is therefore an object of the present invention to provide a connector plug with a locking mechanism which has an excellent electromagnetic shield property and is easy to assemble.

According to the present invention, an insulating body made of a resin material and holding pin contacts is housed in a cylindrical front half portion of a metal cover which has a semi-cylindrical rear half portion, and the cylindrical portion has tongue-shaped locking pieces each having a protrusion. The semi-cylindrical rear half portion of the metal cover has attached thereto a metal clamper for clamping a cable and is covered with a semi-cylindrical metal auxiliary cover. Elastic support pieces of a resin material for supporting the tongue-shaped locking pieces on the inside thereof are provided and they are biased forwardly by a coiled spring mounted around the metal cover. The rear half portion of the metal cover and the auxiliary cover are received in a cap of a resin material for holding the entire plug structure, and the entire plug structure is covered with a tubular member of a resin material which moves the support pieces.

DESCRIPTION OF THE PREFERRED EMBODIMENT

Figure 1:
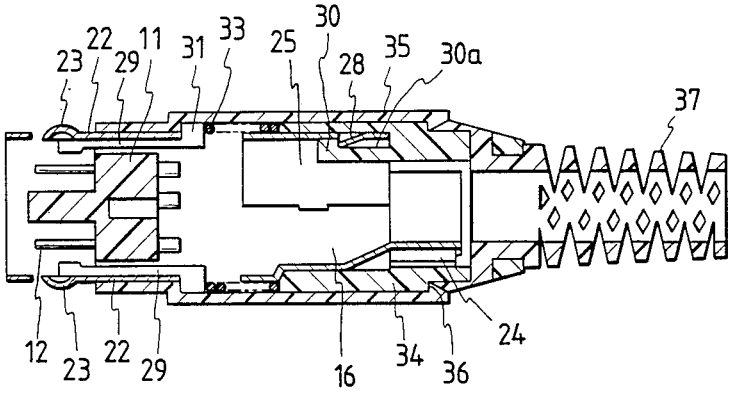
FIG. 1 is a sectional view illustrating an embodiment of the present invention.
Figure 2:
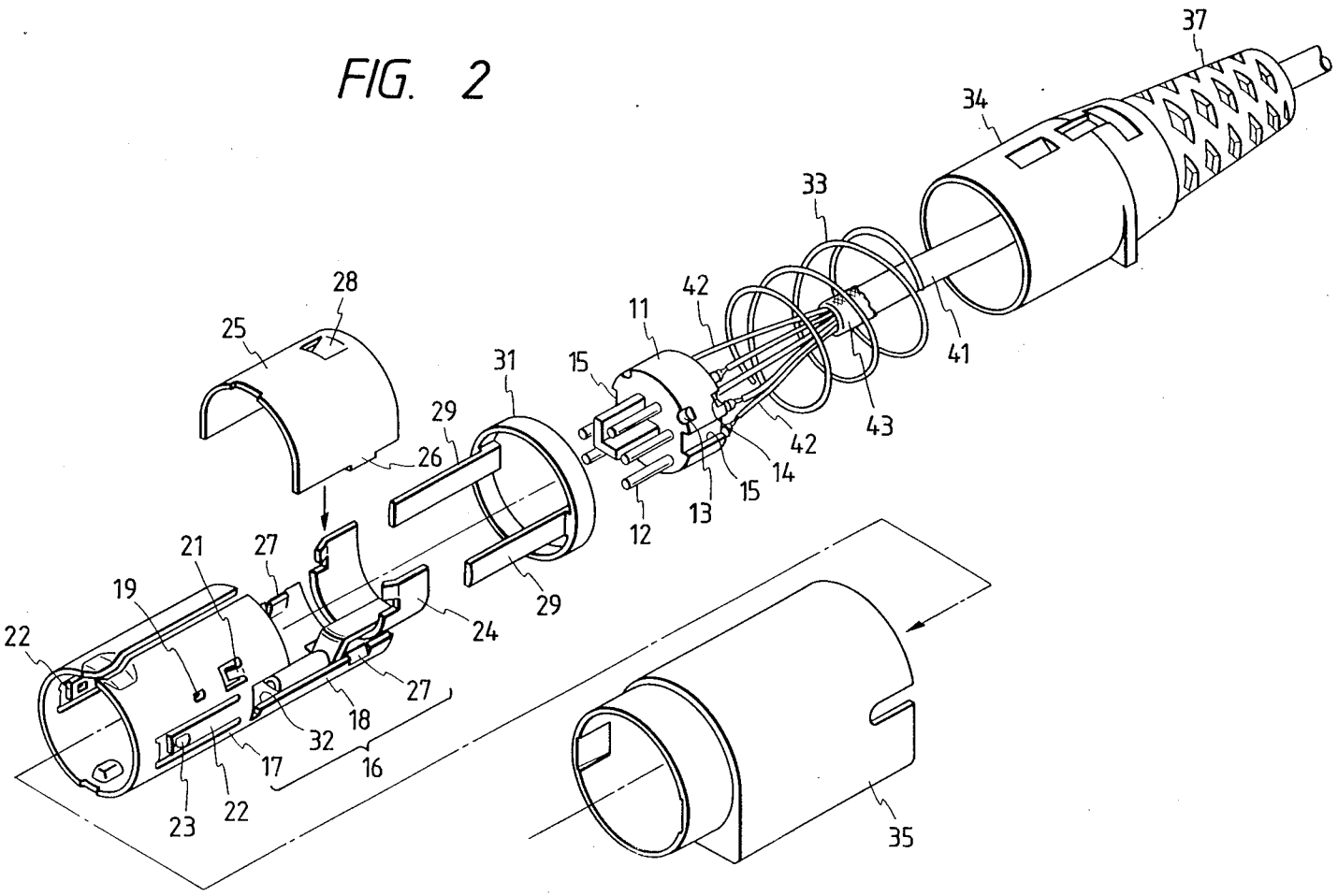
FIG. 2 is its exploded perspective view.

FIG. 1 shows a longitudinal section of an embodiment of the connector plug with a locking mechanism according to the present invention and FIG. 2 its exploded perspective view. The principle of operation of the locking mechanism employed in this embodiment is the same as the principle of operation used in the aforementioned United States patent and the United States application filed in the name of the present inventor.

An insulating body 11 of a resin material is a drum-shaped member relatively short in its axial direction and has pin contacts 12 passing therethrough axially thereof. The body 11 has in its peripheral surface notches 13 and 14 extending in opposite directions from the front and rear marginal edges of the drum-shaped member and grooves 15 extending lengthwise thereof.

The front half of a metal cover 16 is a cylindrical portion 17 and the rear half is a semi-cylindrical portion 18. The body 11 is inserted and held in the front cylindrical portion 17 of the metal cover 16. The cylindrical portion 17 has in its intermediate portion inward protrusions 19 and inward lugs 21 formed side by side in the axial direction thereof for engagement with the notches 13 and 14 of the body 11, respectively, to retain the body 11 in the metal cover 16. Further, the cylindrical portion 17 has in its opposite side portions U-shaped grooves, defining an axially extending pair of tongue-shaped locking pieces 22 each coupled at their rear ends to the cylindrical portion 17. Each locking piece 22 has in its front end an outward protrusion 23.

The rear end of the metal cover 16, that is, the rear end of the semi-cylindrical portion 18 has attached thereto a U-shaped metal clamper 24 for clamping a shielding braid 43 of a cable 41 (not shown in FIG. 1). The semi-cylindrical portion 18 of the cover 16 is covered with a semi-cylindrical auxiliary metal cover 25 to form a new cylindrical portion. The auxiliary cover 25 has a pair of projecting pieces 26 projecting from axial marginal sides thereof for engagement with recesses 27 formed in axial marginal sides of the semi-cylindrical portion 18, by which the auxiliary cover 25 is positioned relative to the semi-cylindrical portion 18. The auxiliary cover 25 has an engaging lance 28 projecting inwardly thereof.

The locking pieces 22 are each supported by an elastic support piece 29 disposed on the inside thereof. The support pieces 29 are made of a resin material and connected at their rear ends to a ring-shaped actuating member 31 which is formed as a unitary structure therewith. The inner diameter of the actuating member 31 is slightly greater than the outer diameter of the cylindrical portion 17, and the actuating portion 31 is mounted on the cylindrical portion 17. The cylindrical portion 17 has guide slots 32 extending forwardly from its rear end, for receiving the connecting portions of the support pieces 29 and the actuating member 31. The support pieces 29 are inserted into gaps defined by the interior surface of the cylindrical portion 17 and the grooves 15 of the body 11 in a manner to be slidable along the inner surfaces of the locking pieces 22 lengthwise thereof, respectively.

A coiled spring 33 is disposed around the front cylindrical portion 17 and the rear cylindrical portion formed by the semi-cylindrical portion 18 and the auxiliary cover 25. The front coil of the coiled spring 3 abuts against the ring-shaped member 31, biasing the support pieces 29 forwardly. The cover 16 and the auxiliary cover 25 are put in a cap 34 made of a resin material, namely, the entire plug structure is housed in the cap 34. The cap 34 has an engaging piece 30 extending forwardly from its inner wall. The engaging piece 30 has a recess **30*a* formed in its side face in opposed relation to the inner wall of the cap 34. The engaging lance 28 of the auxiliary cover 25 is inserted between the engaging piece 30 and the inner wall of the cap 34 and is engaged with the recess 30*a* of the engaging piece 30 to prevent the cap 34 from coming out of position. The front end face of the cap 34 abuts against the rear end portion of the coiled spring 33**.

Reference numeral 35 indicates a tubular member made of a resin material, which is put on the plug structure. When the tubular member 35 is mounted on the plug structure, claws 36 formed at the rear end of the tubular member 35 engage recesses of the cap 34 and an annular stepped portion formed on the inside of the forward portion of the tubular member 35 engages the actuating member 31. By pulling back the tubular member 35, the support pieces 29 are slid back through the actuating member 31 against the biasing force of the coiled spring 33. Attached to the rear end of the cap 34 is a bush 37 made of a resin material for protecting the cable 41.

Next, a description will be given of the assembling of the plug connector described above. At first, lead wires of the cable 41 inserted through the bush 37 and the cap 34 are connected to the pin contacts 12 carried by the body 11, which is inserted into the front cylindrical portion of the cover 16 through the coiled spring 33 and the actuating member 31, and then the support pieces 29 are disposed along the guide slots 32. Next, the shielding braid 43 of the cable 41 is brought onto the semi-circular clamper 24 and is then clamped, after which the auxiliary cover 25 is mounted on the semi-cylindrical portion 18. In this instance, the shielding braid 43 of the cable 41 can easily be placed laterally onto the clamper 24 from above, because the latter is semi-circular. After this, the coiled spring 33 is moved onto the semi-cylindrical portion 18 and the auxiliary cover 25, and the cap 34 and the bush 37 are moved along the cable 41 while pressing the coiled spring 33 forwardly and mounted around the semi-cylindrical portion 18 and the auxiliary cover 25. Finally, the tubular member 35 is put on the plug structure from the front of the latter.

As described above, the connector plug of the present invention has a very excellent electromagnetic shielding property because the pin contacts 12 and the lead wires 42 are housed in the metal cover 16, and further, the connector plug is free from a risk of the covers 16 and 25 coming out of position or falling off and is easy to assemble. Since the rear half of the metal cover 16 is semi-cylindrical, the body 11 having connected thereto the cable can easily be assembled with the metal cover 16. Furthermore, the coiled spring 33 mounted around the metal cover 16 and the auxiliary cover 25 serves to prevent the auxiliary cover 25 from coming off the metal cover 16 when the former is mounted on the latter. In addition, the engaging piece 30 of the cap 34 is elastic, and hence is elastically deformed inwardly when the cap 34 is put on the plug structure; as a result the engaging lance 28 of the auxiliary cover 25 can easily be inserted between the engaging piece 30 and the inner wall of the cap 34 and engaged with the recess **30*a* of the engaging piece 30 though the engaging lance 28** is hard and is not readily deformed.

It will be apparent that many modifications and variations may be effected without departing from the scope of the novel concepts of the present invention.

What is claimed is:

1. A connector plug with a locking mechanism comprising:

an insulating body made of a resin material and carrying pin contacts;

a metal cover composed of a cylindrical front half portion and a semi-cylindrical rear half portion, said cylindrical portion housing said insulating body and having at least one tongue-shaped locking piece which has a projection and extends forward in the axial direction of said metal cover;

a metal clamper attached to the rear end of said metal cover, for clamping a cable;

an elastic support piece made of a resin material and mounted in said metal cover in a manner to be axially slidable on the inner surface of said tongue-shaped locking piece, said elastic support piece having an actuating member at the rear end thereof;

a semi-cylindrical metal auxiliary cover for covering said semi-cylindrical rear half portion of said metal cover;

a coiled spring mounted around said metal cover, a front end portion of said coiled spring urging said actuating member forwardly to bias said elastic support piece forwardly;

a cap of a resin material into which said semi-cylindrical rear half portion and said auxiliary cover are inserted, for holding the entire connector plug structure; and a tubular member of a resin material for covering said entire connector plug structure, said tubular member having a portion which engages said actuating member to slide said elastic support piece rearwardly when said tubular member is pulled rearwardly.

2. The connector plug of claim 1, wherein said actuating member is a ring-shaped member which has an inner diameter greater than the outer diameter of said cylindrical portion of said metal cover and is slidably mounted around said cylindrical portion of said metal cover, said elastic support piece being integrally fixed at its rear end to the inner periphery of said ring-shaped actuating member.

3. The connector plug of claim 2, wherein said cylindrical portion of said metal cover has a guide slot cut therein and extending axially forwardly from its rear end and the rear, end portion of said elastic support piece is axially slidable along said guide slot.

4. The connector plug of claim 2 or 3, wherein two said elastic support pieces are provided.

5. The connector plug of claim 1, 2 or 3, wherein said insulating body is substantially columnar and has a groove cut in its peripheral surface and extending in its axial direction and said elastic support piece is mounted in said cylindrical portion of said metal cover through said groove.

6. The connector plug of claim 1, 2 or 3, wherein said semi-cylindrical portion of said metal cover and said auxiliary cover have side marginal portions that are in engagement with one another.

* * * * *